United States Patent [19]

Kröner

[11] Patent Number: 5,018,490

[45] Date of Patent: May 28, 1991

[54] HEATING SYSTEM, IN PARTICULAR FOR MOTOR VEHICLES, WITH AN INTERNAL COMBUSTION ENGINE AND A HEATER

[75] Inventor: Martin Kröner, Lorch, Fed. Rep. of Germany

[73] Assignee: J. Eberspächer, Esslingen, Fed. Rep. of Germany

[21] Appl. No.: 515,161

[22] Filed: Apr. 26, 1990

[30] Foreign Application Priority Data

Apr. 28, 1989 [DE] Fed. Rep. of Germany ..... 3914154

[51] Int. Cl.[5] ..... F01M 1/00; B60H 1/22

[52] U.S. Cl. ..... 123/196 AB; 237/12.3 C

[58] Field of Search ..... 123/41.33, 196 AB; 237/12.3 C, 12.3 R

[56] References Cited

U.S. PATENT DOCUMENTS

| | | | |
|---|---|---|---|
| 4,150,655 | 4/1979 | Gaggiano | 123/196 AB |
| 4,156,407 | 5/1979 | Moll et al. | 123/196 AB |
| 4,245,593 | 1/1981 | Stein | 123/196 AB |
| 4,249,491 | 2/1981 | Stein | 123/196 AB |
| 4,352,455 | 10/1982 | Moser et al. | 123/196 AB |
| 4,397,269 | 8/1983 | Hatz | 123/196 AB |
| 4,545,334 | 10/1985 | Nakagawa et al. | 123/41.33 |
| 4,632,306 | 12/1986 | Bleeker et al. | 237/12.3 C |
| 4,936,505 | 6/1990 | Hall | 237/12.3 C |

*Primary Examiner*—E. Rollins Cross

*Attorney, Agent, or Firm*—McGlew & Tuttle

[57] ABSTRACT

A heating system, in particular for motor vehicles, which utilizes waste heat of an internal combustion engine and has a heater that can be operated with liquid fuel for generating heat independently of the operation of the internal combustion engine or in addition to the waste heat of the engine, wherein the heater is associated with an oil storage space of the internal combustion engine. The heater is arranged with its direction of principal extension essentially in parallel to the axis of the crankshaft and eccentrically, mainly in the oil pan of the internal combustion engine.

3 Claims, 2 Drawing Sheets

HEATING SYSTEM, IN PARTICULAR FOR MOTOR VEHICLES, WITH AN INTERNAL COMBUSTION ENGINE AND A HEATER

FIELD AND BACKGROUND OF THE INVENTION

The present invention pertains to a heating system, especially for motor vehicles, which system uses the waste heat of an internal combustion engine and has a heater that can be operated with liquid fuel for generating heat independently of the operation of the internal combustion engine or in addition to the waste heat of the engine, wherein the heater is associated with an oil storage space of the internal combustion engine.

Heaters for motor vehicles, which can be operated with liquid fuel and which generate heat independently of or in addition to the operation of the internal combustion engine, are known. Their most important field of application is the preheating of the interior of the motor vehicle and/or the internal combustion engine, so that when driving off, the user of the motor vehicle already finds a warm vehicle interior with thawed windshields and a vehicle drive engine that is no longer excessively undercooled. The wear on the internal combustion engine due to cold start is substantially reduced. In addition, the exhaust gas emissions during the warm-up phase are reduced.

It is known from West German Offenlegungsschrift DE-OS 37,12,670 that the heater can be spatially associated with the oil pan of the internal combustion engine such that the heater not only heats water for the vehicle heating, but also supplies heat, over the shortest way possible, to the oil of the internal combustion engine, which oil is located in the oil pan.

SUMMARY AND OBJECT OF THE INVENTION

The basic task of the present invention is to integrate the heater in such a heating system in a more favorable manner.

To accomplish this task, the heater is arranged according to the present invention with its direction of principal extension essentially in parallel to the axis of the crankshaft and eccentrically, mainly in the oil pan of the internal combustion engine.

In the prior-art heating system described, the direction of principal extension of the heater is at right angles to the axis of the crankshaft and the heating system as a whole is located under the crankshaft. This leads to an increase in the overall height of the internal combustion engine. In contrast, the design of the heating system according to the present invention causes at most only a slight increase in the overall height of the internal combustion engine. This is highly desirable, because one seeks to arrange the hoods of modern motor vehicles as low as possible, and because the internal combustion engine cannot be arranged as low as may be desired, because of the necessary ground clearance.

The principal area of the heater is usually, generally speaking, cylindrical. In embodying the present invention, this principal area is designed with the smallest possible diameter, and there are less rigorous limitations in terms of length.

It has been mentioned above that the heater is associated in space with an oil storage space of the internal combustion engine. The oil storage space may be the oil pan of the internal combustion engine. On the other hand, for example in the case of internal combustion engines with dry sump lubrication or other separate oil storage space, the heater may, instead, be associated in space with an oil tank or be arranged largely within same. The position of the direction of principal extension of the heater relative to the axis of the crankshaft is not relevant in this case.

Furthermore, the present invention provides a heating system in which the internal combustion engine is provided with liquid cooling and an electric circulating pump for the coolant, in which the heater is designed as a liquid—heating heater, and in which the heater is integrated within the coolant—heating system of the internal combustion engine, so that the circulating pump is able to pump coolant through the heater while the internal combustion engine is not running. Based on this design, the hitherto common liquid circulating pump of the heater is dispensable. Its function is taken over by the electric circulating pump of the internal combustion engine. An electric circulating pump for the coolant has the great advantage that it is able to operate independently of the instantaneous speed of rotation of the internal combustion engine, and especially that its actual delivery capacity can be adjusted to the actual cooling need of the internal combustion engine or the amount of heat required for heating the interior of the vehicle.

Furthermore, the present invention provides a heating system in which the lubricating oil circuit of the internal combustion engine is equipped with an electric oil pump, so that the internal combustion engine when not running can be heated with circulated lubricating oil heated by the heater. This leads to a more peripheral preheating of the internal combustion engine, because the lubricating oil circulation practically leads through the entire internal combustion engine. In addition, compared with an oil pump driven mechanically by the internal combustion engine, an electric oil pump offers the essential advantage that its delivery volume or its delivery pressure can be selected independently of the instantaneous speed of the internal combustion engine. In particular, it is possible to increase the delivery volume or the delivery pressure at idle or low speeds compared with the previous practice with mechanical drive of the oil pump.

It is pointed out that the described design of the coolant circuit with electric circulating pump and integration of the heater as well as the described design of the lubricating oil circuit of the internal combustion engine with electric oil pump and integration of the heater can also be realized independently of the mounting position of the heater as specified in claim 1. Consequently, the measures described can also be used when the heater is not arranged with its direction of principal extension essentially in parallel to the axis of the crankshaft, mainly in the oil pan of the internal combustion engine. It is also pointed out that the heater may also be a heater that can be operated with gas.

The association in space of the heater with the oil pan or the oil tank of the internal combustion engine may also be used according to the present invention to remove heat from the hot lubricating oil of the internal combustion engine during operation with high power and/or at high outside ambient temperatures. Based on the present invention, the oil pan or the oil tank is virtually integrated with a heat exchanger through which the coolant of the internal combustion engine is able to flow. During the operation of the internal combustion engine with high power or at high ambient temperatures, the coolant of the internal combustion engine has a lower temperature than the lubricating oil, which may easily be at a temperature exceeding 140° C. under the conditions described. It is emphasized that the measure described in this paragraph can also be realized independently of the measures described farther above. In particular, it is possible to provide such an integration of the heat exchanger in the oil pan or the oil tank of the internal combustion engine, even though no heater is installed in the vehicle in question or a heater is installed in it in another position.

Finally, it is emphasized that the heater is either a so-called water heater, which releases the heat generated onto a liquid acting as a heat carrier, or a so-called air heater, which releases the heat generated primarily to air acting as the heat carrier.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which a preferred embodiment of the invention is illustrated.

DETAILED DESCRIPTION OF THE PREFERRED EMBODIMENT

Figure 1:
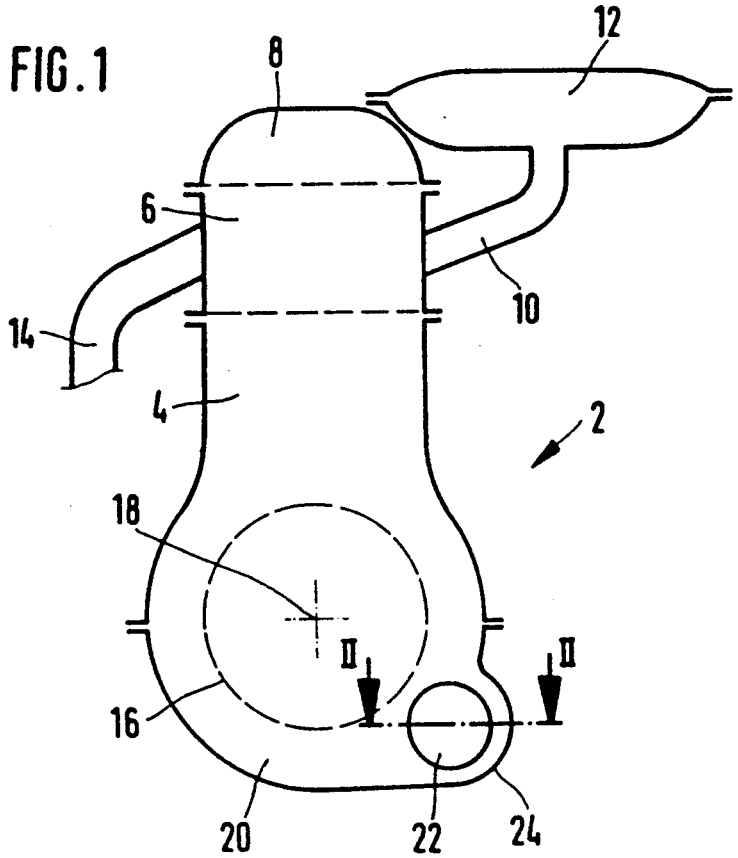
FIG. 1 is a schematic front view of an internal combustion engine with heater integrated in the oil pan, viewed in the direction of the longitudinal axis of the crankshaft and from the rear side of the internal combustion engine.

FIG. 1 shows an internal combustion engine 2 with cylinder block 4, cylinder head 6, valve cover 8, air intake system 10, air filter 12 and the beginning of the exhaust system 14. A crankshaft 16 is schematically indicated with crankshaft axis 18, and an oil pan 20. The oil pan 20 is bulged out on the side, without increasing its vertical dimensions, in order to create a space for receiving a heater 22 eccentrically from the crankshaft axis 18.

Figure 2:
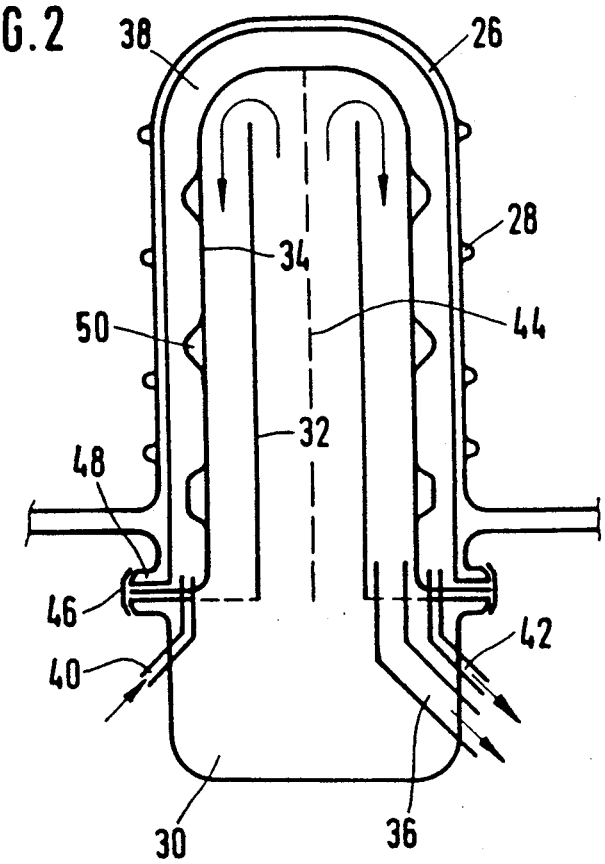
FIG. 2 is a partial horizontal longitudinal sectional view of the internal combustion engine according to FIG. 1 taken along line II—II, on an enlarged scale and limited to the area in which the heater is arranged; and, FIG. 3 is a coolant circuit layout of an internal combustion engine with a heater associated with it.

FIG. 2 shows in greater detail how the heat exchanger area of the heater 22, which accounts for most of the space of the heater 22, is integrated in the oil pan 20. In the area of the described bulge 24 of the oil pan 20 is located a more or less cylindrical invagiation or pocket 26 in the oil pan 20. The pocket 26 is open toward the front or rear end of the internal combustion engine 2, but is otherwise closed everywhere, and is made in one piece with the rest of the oil pan 20. The oil pan 20 with the pocket 26 is preferably made of metal, especially die-cast aluminum. However, it may also consist of plastic. The outside of the pocket 26 or the side facing the inside of the oil pan 20 may be provided with ribs 28 in order to improve the heat transfer. The direction of axial extension of the pocket 26 is parallel to the crankshaft axis 18. The length of the pocket 26 in the axial direction depends on the desired or needed heat capacity of the heater 22. The length may almost reach the overall length of the oil pan 20. However, the pocket 26 may also be axially shorter, e.g., to leave space, axially in front of it, for an oil pump or an intake system for the oil circuit (not shown) of the internal combustion engine 2.

The heater 22 proper, which is shown partially schematically in FIG. 2, consists essentially of a heater base part 30, an essentially cylindrical flame tube 32 projecting from it axially, and a jacket 34 made of metal, which surrounds the flame tube 32. The base part 30 contains essentially a combustion air blower, a fuel pump, which may also be arranged in a separate place if desired, a combustion chamber at the transition to the flame tube 32, an electrical ignition device in the combustion chamber, and a temperature sensor (overheat protection switch), but the elements are not shown separately. The flame tube 32 is open at the face end remote from the base part 30. The essentially cylindrical jacket 34 is closed at its end 34 adjacent to the open end of the flame tube 32. The hot combustion gases stream axially in the forward direction in the flame tube 32 and then back axially in the annular chamber between the flame tube 32 and the jacket 34. They leave the heater 22 through an exhaust gas pipe 36. A chamber 38, through which the coolant of the internal combustion engine 2 flows, is located between the generally deep beaker-shaped jacket 34 and the generally deep beaker-shaped pocket 26; wherein an inlet pipe 40 and an outlet pipe 42 are indicated schematically. To achieve a controlled flow through the chamber 38, it may be subdivided, e.g., below the plane of the drawing in FIG. 2 and above the plane of the drawing in FIG. 2, by an axially extending partition 44, which ends axially in front where the jacket 34 does. Thus, the coolant flows in half of the chamber 38 which is to the left in FIG. 1, reaches the right-hand half axially in the forward direction from the left-hand half and flows back axially on the right-hand side in FIG. 1. Analogously, it would also be possible to provide for forward flow in the upper half of the chamber 38 and a back flow in the lower half of the chamber 38. There are also other possibilities for appropriately guiding the flow, for example, forward flow in the chamber 38 as a whole and back flow through a separate line. The combustion gases of the heater 22 release most of their heat through the jacket 34 to the coolant flowing through the chamber 38, and the coolant releases at least part of its heat through the wall of the pocket 26 to the lubricating oil in the oil pan 20.

The base part 30 and the jacket 34 have flanges which are fastened by means of a common clamping ring 46 on a corresponding, external flange 48 of the oil pan 20. The jacket 34 is provided inside and/or outside with elevations 50 or ribs, which may extend, e.g., in a helical shape, in order to render the liquid or gas stream through the corresponding chamber more turbulent and thus to increase the heat transfer.

As an alternative, it is possible to leave only a corresponding opening on the rear side of the oil pan 20 instead of providing the oil pan 20 with the pocket 26. A heater 22 can be inserted over most of its length into this opening, and in this case, the heater has an enclosing outer jacket essentially corresponding to the above-described pocket 26. This outer jacket is to be connected to the oil pan 20 in a liquid-tight manner, e.g., by means of a flange.

The solution shown has the advantage that the oil pan has no potential leakage site.

If the buyer of a motor vehicle does not wish to have an auxiliary heater, the oil pan 20 described can still be used by simply leaving the pocket 26 free on the inside in the variant shown or closing the opening with a cover in the variant not shown. However, it is also possible to install a conventional oil pan 20 without bulging part 24 in this case.

It is also possible to use the pocket 26 without the heater 22 to provide channels there, through which the coolant of the internal combustion engine 2 flows in order to thus achieve more rapid heating of the lubricating oil during the warm-up phase of the internal combustion engine 2 and cooling of the lubricating oil by the coolant of the internal combustion engine 2 during the operation of the internal combustion engine 2 at high power.

Figure 3:
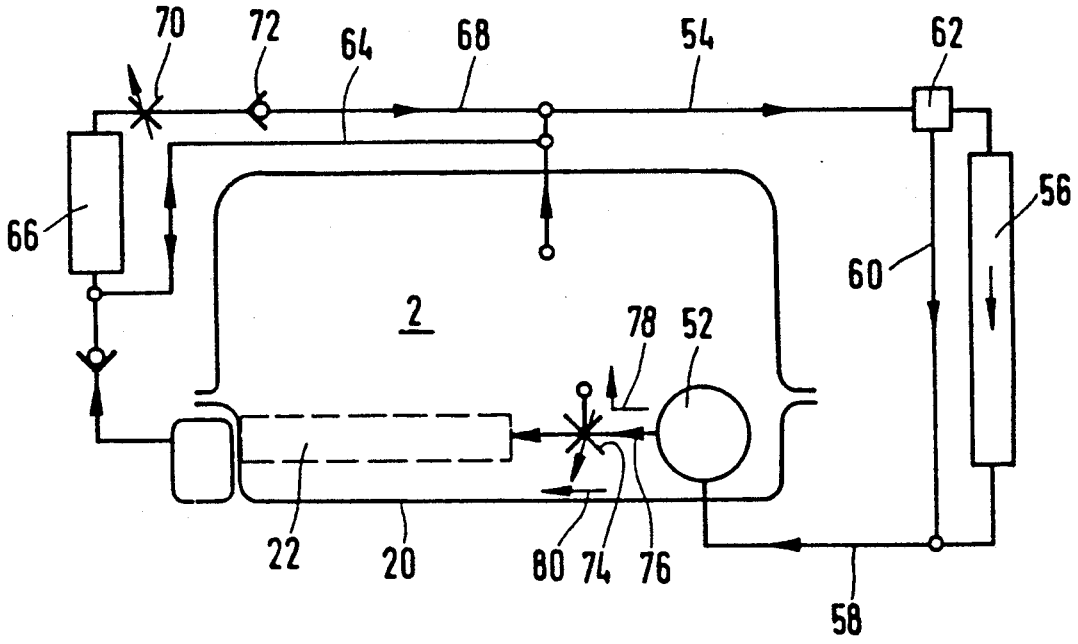

FIG. 3 shows a preferred example on how the heater 22 can be integrated within the coolant circuit of the internal combustion engine 2. This is an embodiment in which the heater 22 has no liquid pump of its own and in which an electrically driven circulating pump 52 is provided for the coolant of the internal combustion engine 2.

A first part of the entire coolant circuit of the internal combustion engine 2 consists essentially of the circulating pump 52, whose outlet is connected via a line 76 to coolant flow chambers in the internal combustion engine 2, a line 54 leading from the other end of the coolant flow chambers to a cooler 56, which is arranged in the front of the vehicle and is exposed to the relative wind, another line 58, which returns from the cooler 56 to the circulating pump 52, and a bypass line 60, which extends past the cooler 56 and leads from the line 54 to the line 58. A thermostat valve 62, which permits the coolant to flow through the bypass line 60 when the internal combustion engine 2 is cooled and through the cooler 56 when the internal combustion engine 2 is hot, is installed at the beginning of the bypass line 60.

A second part of the coolant system contains essentially a first line 64, a heat exchanger 66 associated with the interior of the vehicle, and a second line 68. The first line 64 is connected to the line 54 previously described near the internal combustion engine 2 with a T-piece. The second line 68 is also connected, somewhat farther away, to the line 54 with a T-piece. When a heating valve 70 is opened in the second line 68, a component stream of the coolant flows through the heat exchanger 66, as a result of which the interior of the vehicle is heated. A check valve 72 determines the direction of flow in the line 68.

A third part of the coolant system leads to an adjustable valve 74, which is provided in the line 76, to the heater 22 and from there, with a T-piece, into the first line 64 described.

When the adjusting valve 74 is set in the direction of the bent arrow 78 and the heater 22 is not turned on, the coolant circuit operates as a conventional coolant circuit without auxiliary heater. When the adjusting valve 74 is set in the direction of the straight arrow 80, the total amount of coolant first flows, behind the pump 52, through the heater 22, where it is heated when the heater 22 is turned on. When the heating valve 70 is open, the heated coolant first flows through the heat exchanger 66, so that part of the heat is released into the interior of the vehicle. The coolant subsequently flows through the bypass line 60, assuming that the thermostat valve 62 is in the corresponding position, and from there back to the pump 52. This is also the valve position in which the heat generated in the heater 22 is used to preheat the lubricating oil in the oil pan 20, on one hand, and, on the other hand, to heat the interior of the vehicle via the heat exchanger 66, doing so, if desired, even with the internal combustion engine 2 stopped. When the heating valve 70 is closed, the coolant flows through the first line 64 to the line 54. When the adjusting valve 74 is set in an intermediate position, the stream of coolant arriving from the pump 52 is split into two component streams, i.e., a first component stream flowing through the internal combustion engine 2 and a second component stream flowing through the heat exchanger 66, providing that the heating valve 70 is open. The heat generated by the heater 22 is consequently used not only to heat the interior of the vehicle, but also to heat the internal combustion engine 2 via the coolant. This position of the adjusting valve 74 is therefore suitable, besides heating the interior of the vehicle, for heating the internal combustion engine 2 not only via the contents of the oil pan 20, but also via the coolant. In addition, this position is suitable for operating situations in which the internal combustion engine 2 fails to generate enough heat, e.g., during short-distance driving in winter, so that the heater 22 operates as an auxiliary heater. The applicant considers such auxiliary heating tasks to be increasingly important, especially for applications in which the internal combustion engine of a motor vehicle fails to produce enough heat in numerous operating phases. This applies, in particular, to drive motors with small displacement, drive motors with high efficiency and therefore reduced waste heat production, as well as diesel engines.

It is obvious that the coolant circuit described on the basis of FIG. 3 is only one, albeit preferred, embodiment. There are a number of further possibilities for designing the coolant circuit. If a heater 22 with a circulating pump is used for the heat carrier liquid and a conventional, mechanically driven circulating pump 52 for the coolant of the internal combustion engine, the heater 22 can be connected to the heat exchanger 66, for example, such that the heat carrier liquid heated in the heater 22 flows to the heat exchanger 66 and returns therefrom directly to the heater 22, or the heater 22 may also be connected to bypass the circulating pump 52, so that heated heat carrier liquid flows through the internal combustion engine 2 to heat same and, in addition—if connected—through the heat exchanger 66.

As an alternative, the main part of the heater 22 extending into the oil pan 20 and the pocket may also be slightly conical, with diameters decreasing in the forward direction, or be arranged such that, instead of the pocket, part of the circumference is directly integrated in the wall of the oil pan.

It is pointed out that as an alternative, the heater 22 may also be an air heater. In this case, air streams through the chamber 38 described on the basis of FIG. 2. As before, the oil in the oil pan 20 is heated by the air streaming through the chamber 38. The air leaving the chamber 38, which still contains part of its heat content, can be blown, for example, into the interior of the vehicle.

Finally, it is pointed out that the heating system according to the present invention is suitable not only for motor vehicles, such as passenger cars, trucks, buses, ships, construction equipment, etc., but for other applications as well, wherever an internal combustion engine is present. Gasoline stations, power generating stations, etc., can be mentioned as examples.

The heater 22 is operated with the same fuel as the internal combustion engine 2, especially gasoline or diesel fuel.

While a specific embodiment of the invention has been shown and described in detail to illustrate the application of the principles of the invention, it will be understood that the invention may be embodied otherwise without departing from such principles.

What is claimed is:

1. A heating system for use with internal combustion engines and a heater operated with liquid fuel for generating heat independently of the operation of the internal combustion engine and in addition to the waste heat of the internal combustion engine, the internal combustion engine having an oil storage space and defining a crank shaft axis, comprising a heater body extending substantially in one direction positioned in parallel to said crank shaft axis and disposed essentrically with respect to said crank shaft axis substantially in said storage space of the internal combustion engine.

2. A heating system according to claim 1, wherein said internal combustion engine includes liquid cooling means and an electric circulating pump for circulating coolant in said liquid cooling means, said heater being provided as a liquid medium heater, said heater being integrated within said cooling means of said internal combustion engine and being connected with said circulating pump for selectively pumping coolant through said heater even when said internal combustion engine is not running.

3. A heating system according to claim 1, wherein said internal combustion engine includes a lubricating oil circuit connected to said oil storage space, an electric oil pump connected to said lubricating oil circuit, said electric oil pump for pumping oil even when said internal combustion engine is stopped, said lubricating oil circuit being connected to said heater for warming lubricating oil in said lubricating oil circuit and for thereby warming said internal combustion engine.

* * * * *